US009431780B2

(12) United States Patent
Hosler, Sr.

(10) Patent No.: US 9,431,780 B2
(45) Date of Patent: Aug. 30, 2016

(54) COAXIAL ADAPTER WITH AN ADAPTER BODY FORWARD PROJECTING MEMBER

(71) Applicant: MegaPhase, LLC, Stroudsburg, PA (US)

(72) Inventor: Robert C. Hosler, Sr., East Stroudsburg, PA (US)

(73) Assignee: MegaPhase, LLC, Stroudsburg, PA (US)

( * ) Notice: Subject to any disclaimer, the term of this patent is extended or adjusted under 35 U.S.C. 154(b) by 0 days.

(21) Appl. No.: 14/733,751

(22) Filed: Jun. 8, 2015

(65) Prior Publication Data

US 2015/0280374 A1 Oct. 1, 2015

Related U.S. Application Data

(63) Continuation of application No. 13/757,507, filed on Feb. 1, 2013, now Pat. No. 9,054,471.

(60) Provisional application No. 61/594,833, filed on Feb. 3, 2012.

(51) Int. Cl.
*H01R 9/05* (2006.01)
*H01R 24/54* (2011.01)

(52) U.S. Cl.
CPC ..... *H01R 24/542* (2013.01); *H01R 24/545* (2013.01)

(58) Field of Classification Search
CPC ..... H01R 2103/00; H01R 9/0518; H01R 13/506; H01R 13/516
USPC ..... 439/582, 902, 63, 578
See application file for complete search history.

(56) References Cited

U.S. PATENT DOCUMENTS

| | | | | |
|---|---|---|---|---|
| 2,813,144 | A | 11/1957 | Valach | |
| 3,432,798 | A | 3/1969 | Brishka | |
| 3,528,052 | A | 9/1970 | Brishka | |
| 3,836,946 | A | 9/1974 | Geiger | |
| 4,368,940 | A | 1/1983 | Sugiura | |
| 4,687,279 | A | 8/1987 | Holland | |
| 5,122,063 | A * | 6/1992 | Cooper | H01R 13/646 403/96 |
| 5,277,590 | A | 1/1994 | Thomas et al. | |
| 5,439,386 | A | 8/1995 | Ellis | |
| 5,971,770 | A | 10/1999 | Richmond | |
| 6,126,482 | A | 10/2000 | Stabile | |
| 6,283,790 | B1 | 9/2001 | Idehara et al. | |
| 6,287,144 | B1 | 9/2001 | Baffert | |
| 6,471,545 | B1 | 10/2002 | Hosler, Sr. | |
| 7,121,883 | B1 | 10/2006 | Petersen et al. | |
| 7,165,974 | B2 | 1/2007 | Kooiman | |
| 7,270,569 | B2 | 9/2007 | Petersen | |

(Continued)

*Primary Examiner* — Hae Moon Hyeon
(74) *Attorney, Agent, or Firm* — Chadbourne & Parke LLP; Neal J. McLaughlin

(57) ABSTRACT

A coaxial adapter comprises an adapter body which includes a forward projecting member aligned along a connector axis. The adapter also includes an outer contact fixed to the adapter body such that a first electrical connection is made between the outer contact and the adapter body by the fixation. A dielectric is disposed at least partially within an internal bore of the adapter body or an internal bore of the outer contact and an inner contact is disposed at least partially within an internal bore of the dielectric. The forward projecting member of the adapter body makes a second electrical connection with the outer contact separate from the first electrical connection, there being no electrical connection between the adapter body and the outer contact between the first electrical connection and the second electrical connection.

9 Claims, 13 Drawing Sheets

(56) References Cited

U.S. PATENT DOCUMENTS

| | | | | |
|---|---|---|---|---|
| 7,381,089 | B2 | 6/2008 | Hosler, Sr. | |
| 7,419,403 | B1 | 9/2008 | Paynter | |
| 7,530,841 | B2 | 5/2009 | Henningsen | |
| 7,621,778 | B1 | 11/2009 | Paynter | |
| 7,753,725 | B2 | 7/2010 | Henningsen | |
| 8,221,161 | B2 | 7/2012 | Leibfried, Jr. | |
| 8,435,073 | B2 * | 5/2013 | Wild | H01R 24/564 439/578 |
| 8,628,352 | B2 | 1/2014 | Nugent | |
| 9,054,471 | B2 * | 6/2015 | Hosler, Sr. | H01R 24/542 |
| 2012/0214338 | A1 | 8/2012 | Nugent | |
| 2012/0252267 | A1 | 10/2012 | Nugent | |
| 2013/0203288 | A1 * | 8/2013 | Hosler, Sr. | H01R 24/542 439/582 |

* cited by examiner

COAXIAL ADAPTER WITH AN ADAPTER BODY FORWARD PROJECTING MEMBER

CROSS-REFERENCE TO RELATED APPLICATION

This application is a continuation of U.S. patent application Ser. No. 13/757,507, filed Feb. 1, 2013, which claims the benefit of U.S. Provisional Application No. 61/594,833, filed Feb. 3, 2012, each of which are hereby incorporated by reference in their entireties.

BACKGROUND

Coaxial cables for transmission of high frequency signals are in widespread use in many military and commercial fields, including research and design laboratories, aviation and land-based applications. Cables configured for transmission of high frequency signals are designed to meet various strength, interference shielding and signal propagation requirements, which vary by application. High frequency cables typically sacrifice flexibility and size in order to meet these requirements.

However, high frequency cables are increasingly being used in space-limited applications. In order to fit high frequency cables within constricted areas, angled adapters may be installed at the ends of high frequency cables to provide a change of direction in a relatively small space.

High frequency signals transmitted through cables are very sensitive to disturbances caused by cable or adapter geometries. This sensitivity is especially apparent when a signal propagation direction is abruptly changed, as in the case of an angled adapter. Thus, there is a need for an angled adapter configured for installation in constricted areas and also configured for the safe transmission of high frequency signals.

SUMMARY

This invention relates to coaxial angled adapters for adjustably connecting a cable to a mating connector having an axis different from an axis of the cable.

In general, in one aspect, the invention features an adapter including a first adapter body having an internal bore, a first dielectric having an inner channel, and having a portion disposed within the internal bore of the adapter body and a portion outside of the first adapter body, a first inner contact disposed within the inner channel of the first dielectric and an outer contact fixed to the adapter body and having an internal opening, the outer contact further having a shoulder inside the internal opening of the outer contact, wherein the portion of the first dielectric outside of the first adapter body is disposed within the internal opening of the outer contact, and the shoulder engaging the dielectric to hold the first dielectric against the first adapter body.

Implementations of the invention may include one or more of the following features. The adapter may further include a second adapter body having a main axis, a second dielectric having an inner channel and a second inner contact disposed at least partially within the inner channel of the first dielectric, wherein the first adapter body has a main axis, the second adapter body engages the first adapter body such that the main axis of the first adapter body and the main axis of the second adapter body form a non-zero adapter angle therebetween and such that the second dielectric is captured between the second adapter body and the adapter body, the second inner contact having an angle substantially similar to the adapter angle, the second inner contact forming an electrical connection with the first inner contact and a portion of the second inner contact being disposed within the inner channel of the second dielectric, and a portion of the second inner contact being disposed within the inner channel of the first dielectric.

The first adapter body may further include an outer contact attachment and a forward projecting member configured within the internal opening of the outer contact, the outer contact may be attached to the first adapter body at the outer contact attachment to provide a first electrical connection between the outer contact and first the adapter body, and the forward projecting member of the first adapter body may be configured to contact the internal opening at a location remote from the outer contact attachment to provide a second electrical connection, there being no electrical connection between the first electrical connection and the second electrical connection.

The internal opening of the outer contact and the first dielectric may be configured in close proximity so as to prevent propagation of errant electric fields. The internal bore of the first adapter body and the first dielectric may be configured such that the first dielectric is not substantially deformed when inserted into the inner bore. The outer contact may include a retaining surface facing towards the first adapter body configured to mechanically retain the dielectric against the first adapter body.

The first inner contact may include a groove therein, the inner channel of the first dielectric includes a ridge therein, and the groove of the first inner contact and the ridge of the first dielectric may be configured to engage one another to retain the first inner contact within the first dielectric. The first adapter body may further include an outer contact attachment and a forward projecting member configured within the internal opening of the outer contact, the outer contact may be attached to the first adapter body at the outer contact attachment to provide a first electrical connection between the outer contact and first the adapter body, and the forward projecting member of the first adapter body may be configured to touch the internal opening at a location remote from the outer contact attachment to provide a second electrical connection, the touch location being configured adjacent to the groove of the first inner contact. There may be no physical connection between the outer contact and the first adapter body in a region between the first electrical connection and the second electrical connection.

BRIEF DESCRIPTION OF THE DRAWINGS

The above mentioned and other aspects, features and advantages can be more readily understood from the following detailed description with reference to the accompanying drawings, wherein.

DETAILED DESCRIPTION

Cable adapters and connectors are described herein, with reference to examples and exemplary embodiments. Specific terminology is employed in describing examples and exemplary embodiments. However, the disclosure of this patent specification is not intended to be limited to the specific terminology so selected and it is to be understood that each specific element includes all technical equivalents that operate in a similar manner. Similarly, while some examples discussed herein concern coaxial cables, adapters and connectors, the present disclosure also relates to cables, adapters and connectors which are not coaxial, such as, for example, multi-conductor cables, adapters and connectors.

Figure 1:
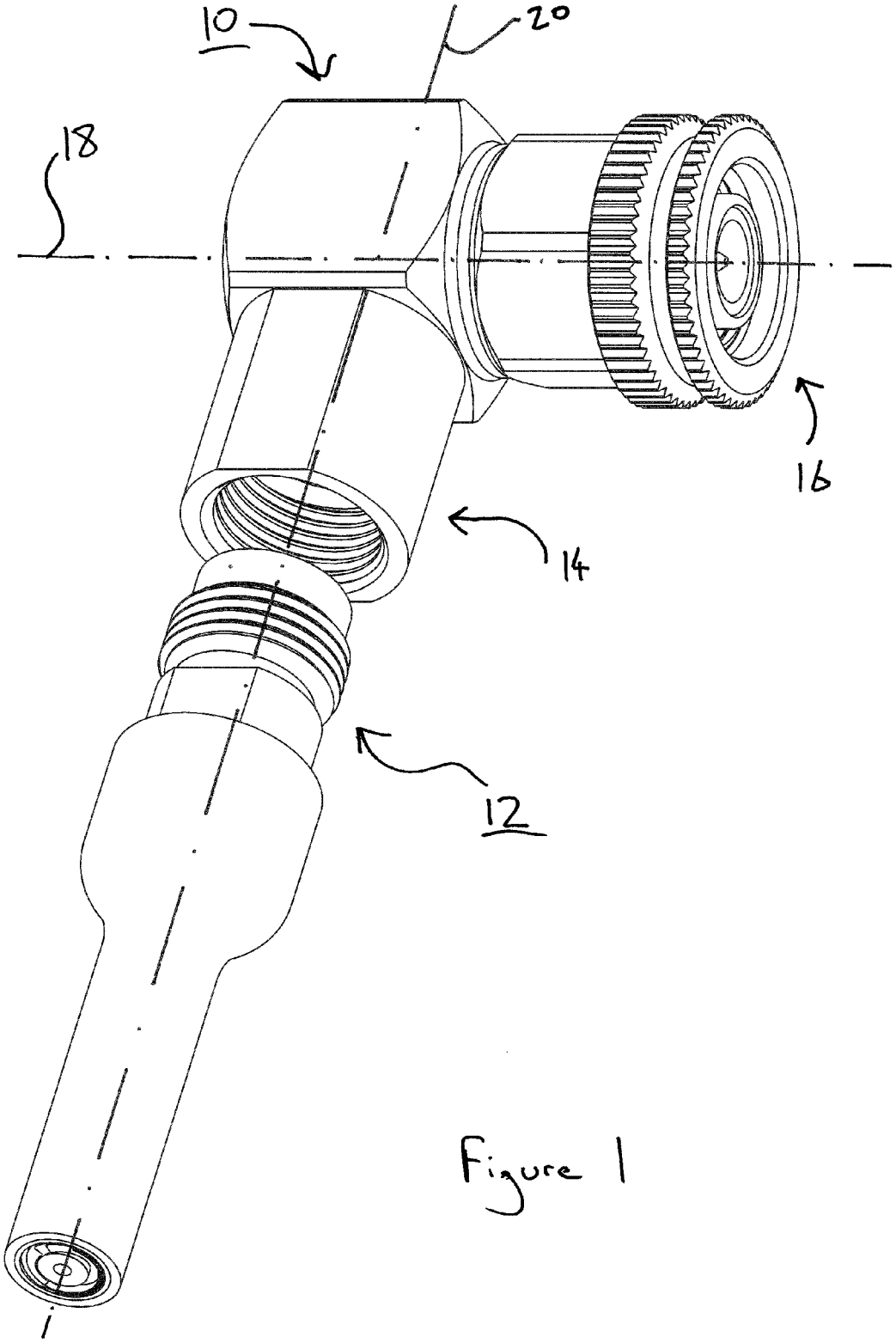
FIG. 1 is a perspective view of a coaxial angled adapter and a cable in a disassembled configuration according to an exemplary embodiment of the present application.

In an exemplary embodiment, shown in FIG. 1, an angled adapter 10 is shown adjacent a cable adapter 12. The angled adapter 10 is provided with a cable attachment end 14 and a connector attachment end 16. The cable adapter 12 may be fixed to a cable, as will be described in more detail below. The angled adapter 10 connects to the cable adapter 12 or another connector at the cable end 14 and provides a connection to an external connector at connector end 16. The connection to the external connector at the connector end 16 is generally oriented along a connector axis 18 which is angled relative to an axis 20 of the cable to which the cable adapter 12 is fixed. In the example shown in FIG. 1, for example, the connector axis 18 and the cable axis 20 are substantially perpendicular. Of course, many other relationships may be provided between the connector axis 18 and the cable axis 20. For example, the connector axis 18 and the cable axis 20 may be oriented at an angle of 15°, 30°, 45°, 60° or 75° (or any other angle) with respect to one another. In another example, the connector axis 18 and cable axis 20 may be substantially parallel or coaxial with one another. In the example shown in FIG. 1, the axes 18 and 20 exist in a single plane and intersect at a point. However, in another example, axes 18 and 20 may not intersect or be aligned in a single plane.

Figure 2:
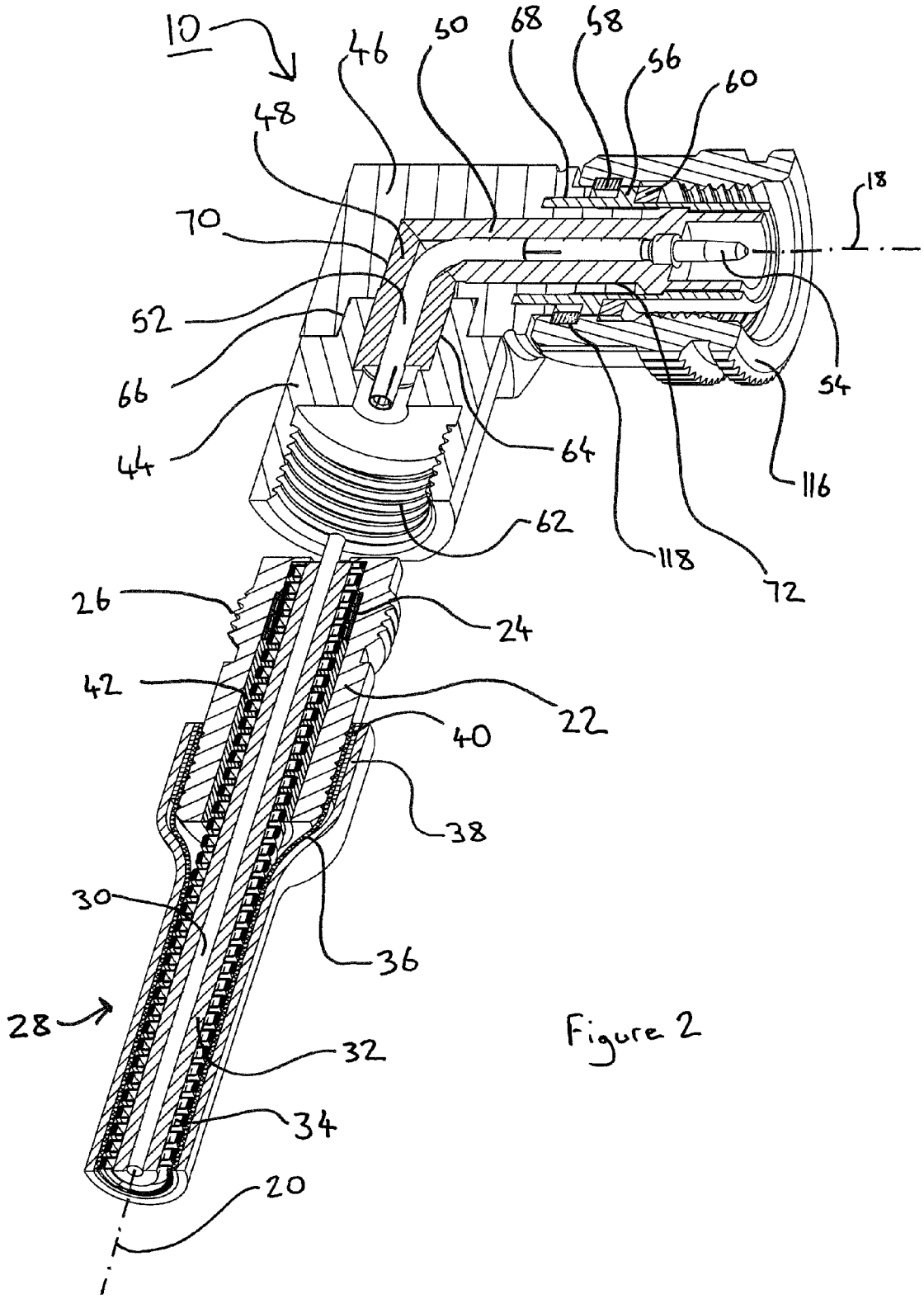
FIG. 2 is a partial perspective cross section view of a coaxial angled adapter and a cable in a disassembled configuration according to an exemplary embodiment of the present application.
Figure 3:
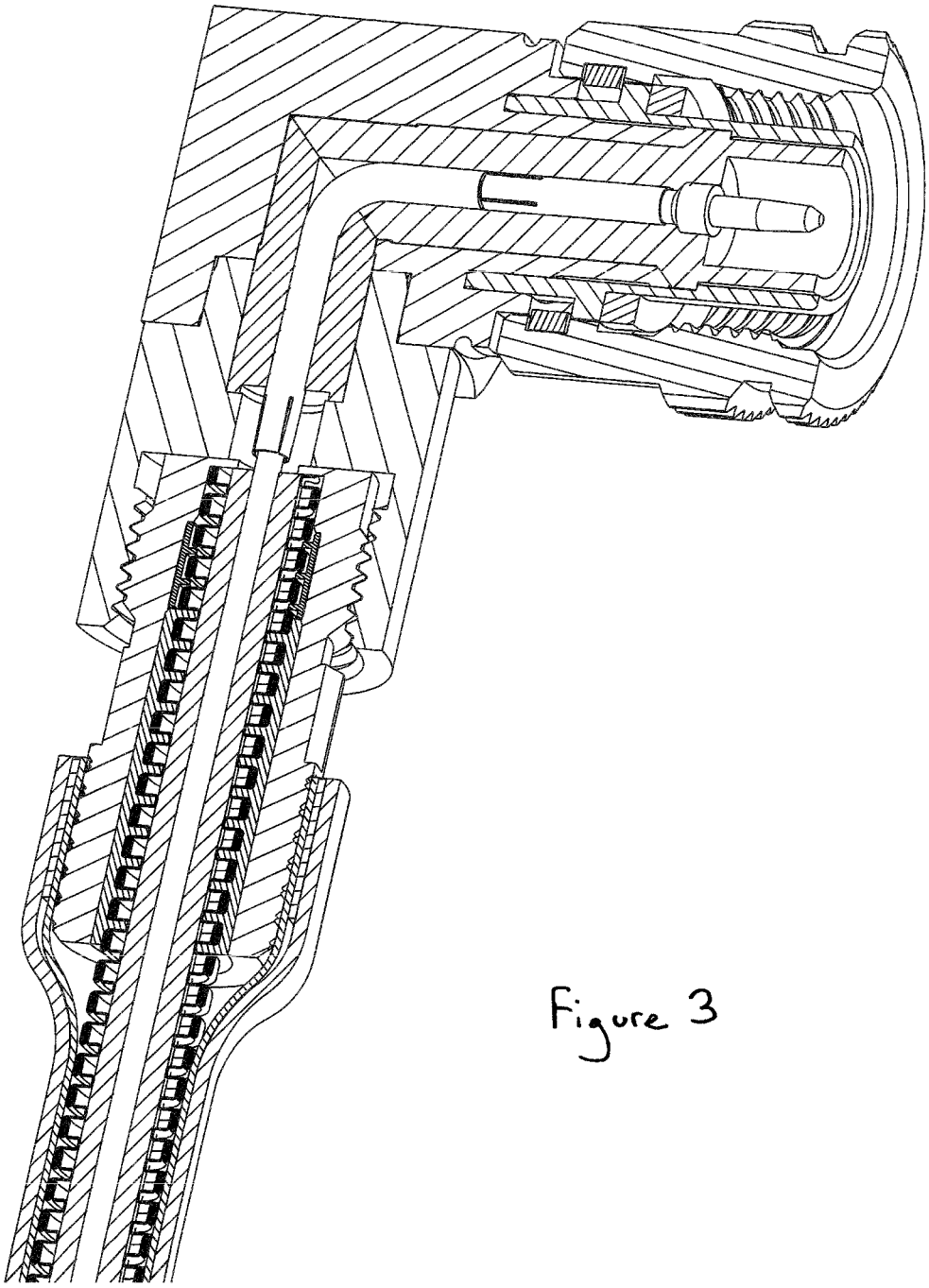
FIG. 3 is a partial perspective cross section view of a coaxial angled adapter and a cable in an assembled configuration according to an exemplary embodiment of the present application.
Figure 4:
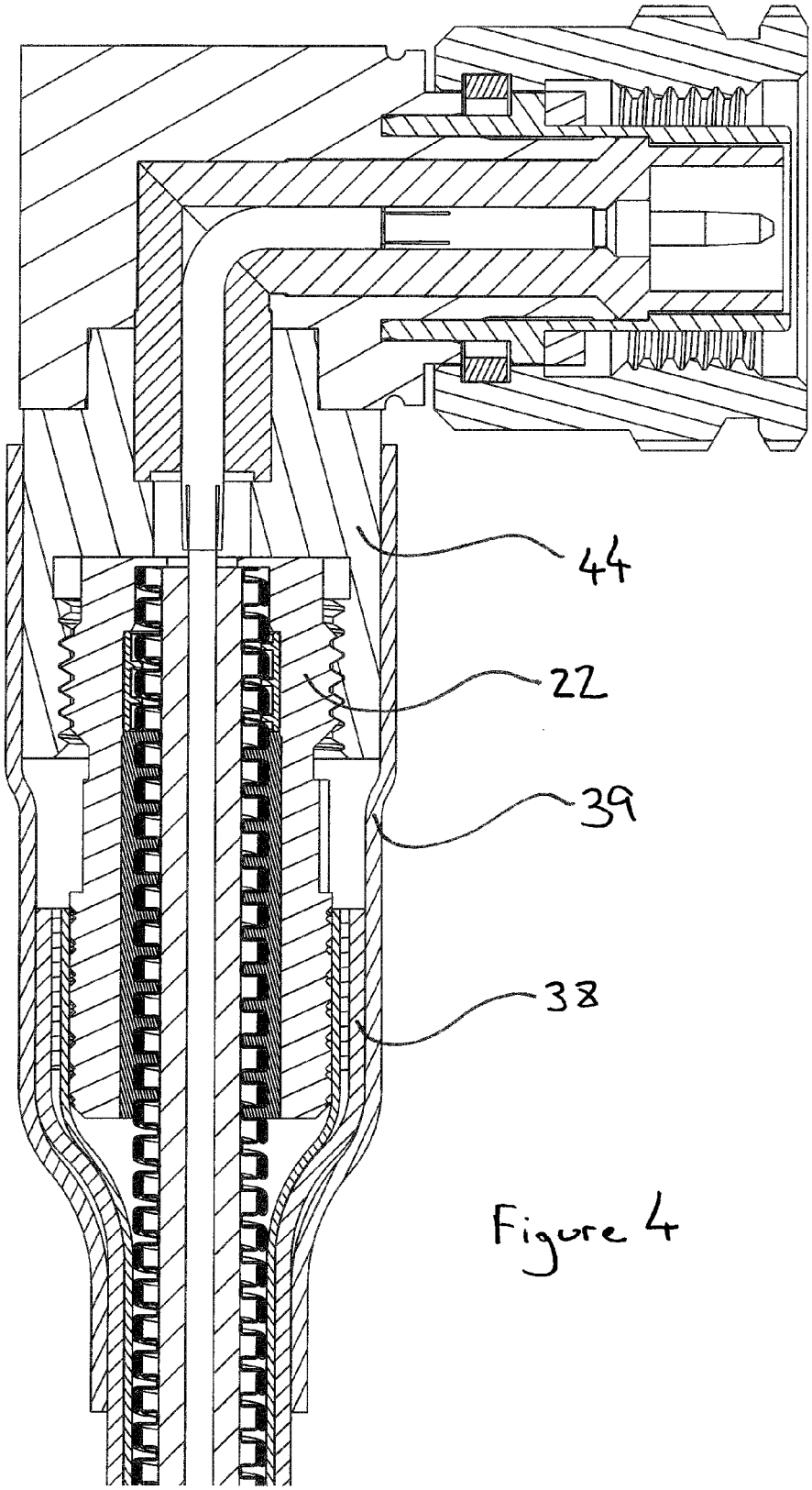
FIG. 4 is a partial side cross section view of a coaxial angled adapter and a cable in an assembled configuration according to an exemplary embodiment of the present application.

FIG. 2 is a partial cross section view of the angled adapter 10 and cable adapter 12 shown in FIG. 1, taken along a plane defined by connector axis 18 and cable axis 20. As shown in FIG. 2, both the angled adapter 10 and the cable adapter 12 may each include a plurality of components. For example, the cable adapter 12 may include a cable adapter body 22 and a threaded cable attachment 24 press-fit into or otherwise attached to a bore of the cable adapter body 22. The cable adapter body 22 may include a threaded portion 26 onto which the angled adapter 10 or other adapter, connector or cable may attach. As shown in FIG. 2, a cable 28 may be attached to the cable adapter 12. In the example shown, a cable 28 includes an inner conductor 30, a dielectric 32, a spiral shielding 34, a braided shielding 36, and a cable jacket 38. As shown, a crimp ring 40 may be crimped over the braided shielding 36 and a knurled surface of the cable adapter body 22. The cable jacket 38 may cover all or part of the braided shielding 36 and crimped crimp ring 40. The spiral shielding 34 may be attached to the cable adapter body 22 first by threading the spiral shielding 34 into complementary threads of the threaded cable attachment 24 and later fixing the components together via a solder joint 42. In another example, shown in FIG. 4, one or more strain relief components 39 may be provided over the jacket 38 and optionally over all or part of the cable adapter body 22 and press sleeve body 44.

As shown in FIGS. 2, 3, 4 and 6, the angled adapter 10 may include a press sleeve body 44, an angled body 46, a press sleeve dielectric 48, a plug dielectric 50, a bent contact 52, a plug contact 54, an intermediate outer contact 56, a c-clip 58, a gasket 60 and coupling nut 116. As shown in FIG. 2, the features of the press sleeve body (such as the threads 62, inner bore 64, and angled body-press sleeve attachment 66) are generally aligned to the cable axis 20 and the features of the angled body 46 (such as the angled body-press sleeve attachment 66, intermediate outer contact receiving groove 68 and inner bores 70 and 72) are generally aligned to either the cable axis 20 or the connector axis 18. In another example, the features of the press sleeve body 44 may be aligned to two or more axes. Similarly, the features of the angled body 46 may be aligned to one axis or more than two axes. In the example shown in FIG. 2, the main axes 18 and 20 of the angled adapter 10 exist in a single plane and intersect at a point. However, in another example, the axes to which features of the press sleeve body 44 and angled body 46 are aligned may not intersect or be aligned in a single plane.

The angled adapter is assembled by inserting the bent contact 52 into the angled body 46 through the inner bore 70. An example of a bent contact 52 is shown in greater detail in FIGS. 7A-7D. As shown, the bent contact 52 includes one or more bends 74 which provide an angle 80 between male 76 and female 78 ends of the bent contact 52, the angle generally corresponding to the angle between the connector axis 18 and the cable axis 20.

Figure 6:
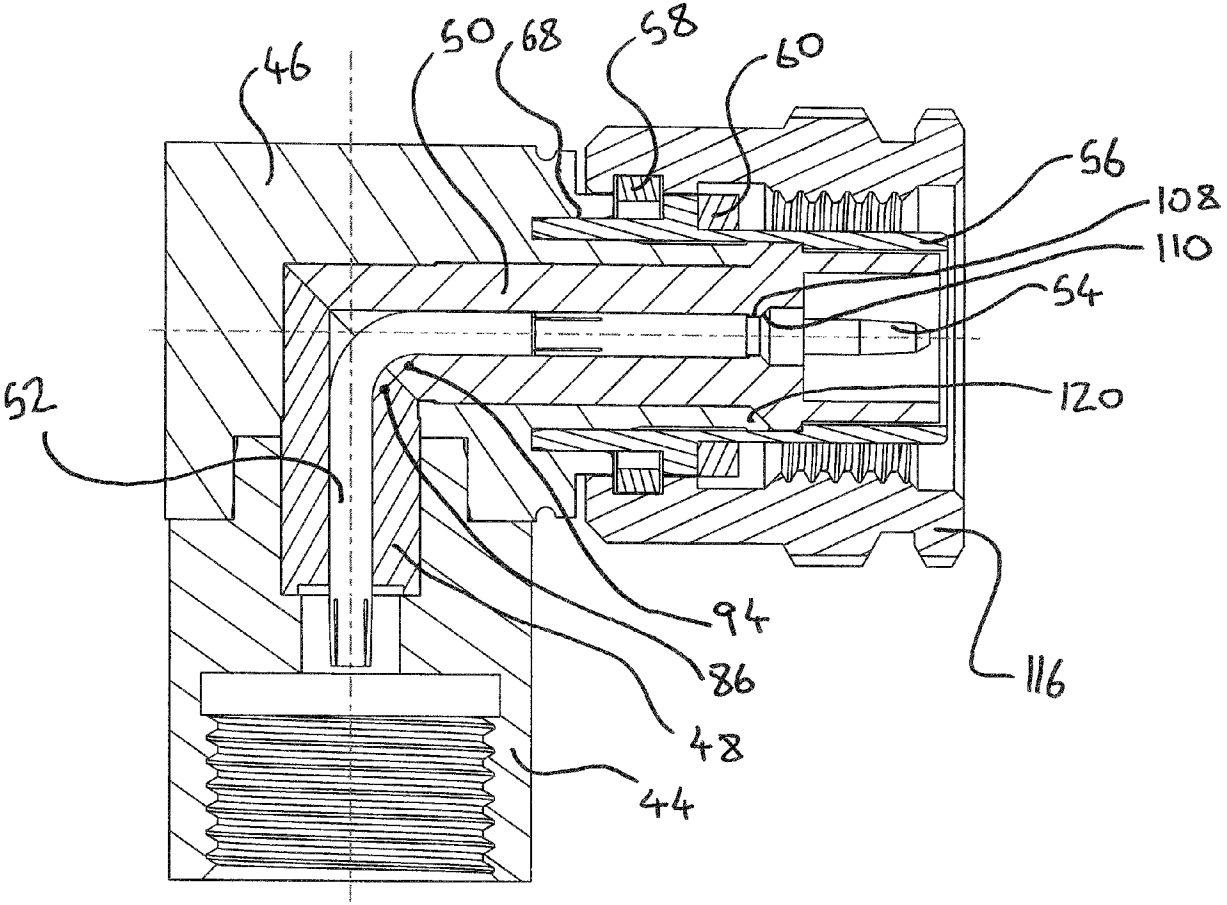
FIG. 6 is a partial side cross section view of a coaxial angled adapter according to an exemplary embodiment of the present application.
Figures 7A, 7B, 7C, 7D:
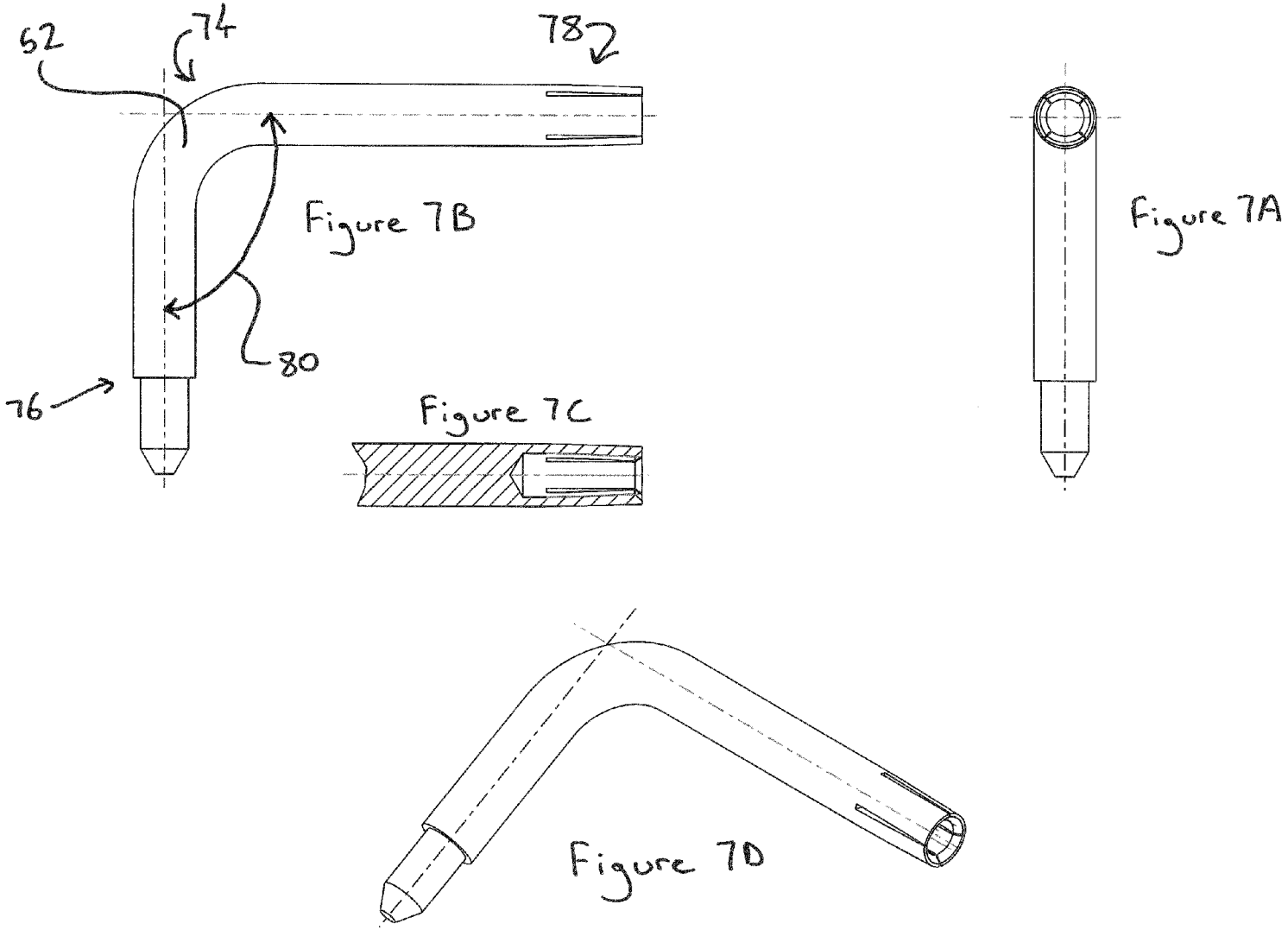
FIGS. 7A, 7B, 7C and 7D are rear side, right side, right side detail cross section and right-rear-top perspective views, respectively, of a bent contact according to an exemplary embodiment of the present application.
Figure 8A:
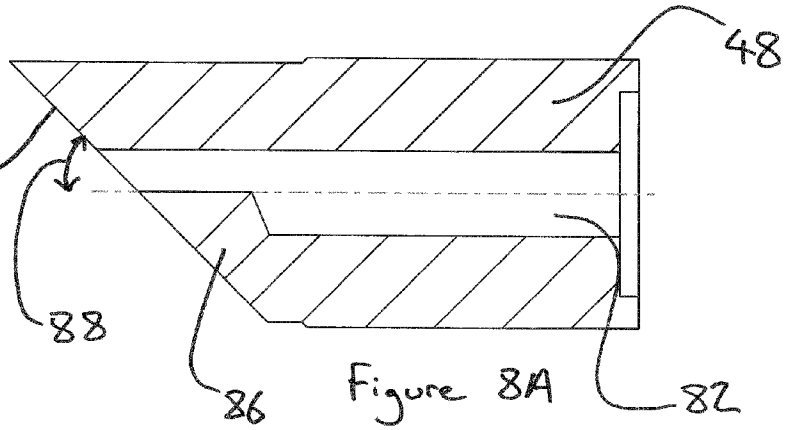
FIGS. 8A, 8B and 8C are left side cross section, left-front-bottom perspective and left-front-top perspective views, respectively, of a press sleeve dielectric according to an exemplary embodiment of the present application.
Figure 8C:
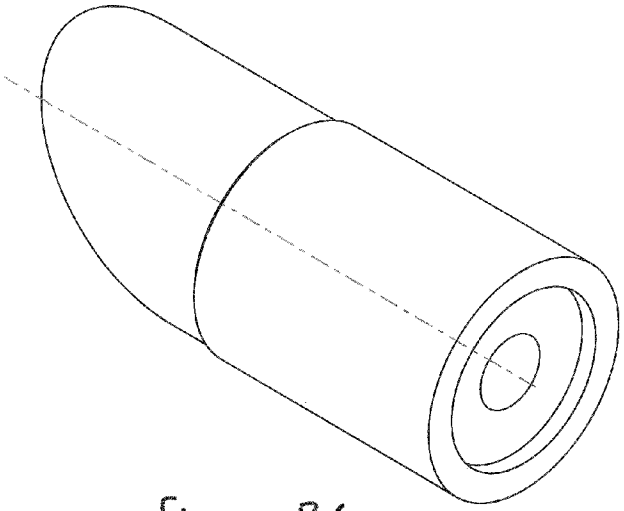
Figure 8B:
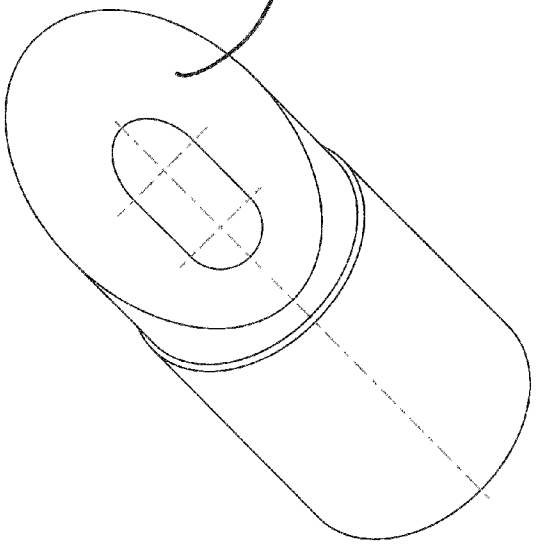

Press sleeve dielectric 48 is inserted over the female end 78 of the bent contact 52 and inside inner bore of the angled body 46. An example of press sleeve dielectric 48 is shown in more detail in FIGS. 8A-8C. As shown in FIG. 8A, which is a cross section of press sleeve dielectric 48 taken along its major axis, press sleeve dielectric 48 includes an inner bore 82 into which the female end 78 of the bent contact 52 is inserted. The press sleeve dielectric 48 also may include a beveled end surface 84 and a bend relief 86. The beveled end surface 84 forms an angle 88 with the main axis of the press sleeve dielectric 48. In one example, angle 88 is configured to be substantially half of the angle between axes 18 and 20 or half of angle 80, although other angles are possible. As shown in FIG. 6, bend relief 86 provides a space for the bend 74 of the bent contact 52 to exist without detrimental impingement.

Figure 9A:
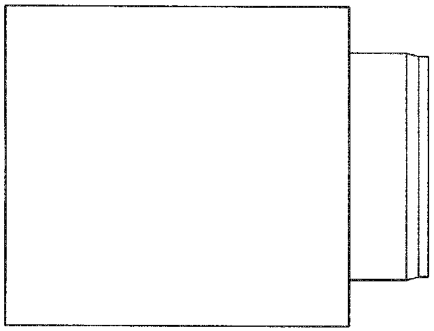
FIGS. 9A, 9B and 9C are top, top cross section and front views, respectively of a press sleeve body according to an exemplary embodiment of the present application.
Figure 9B:
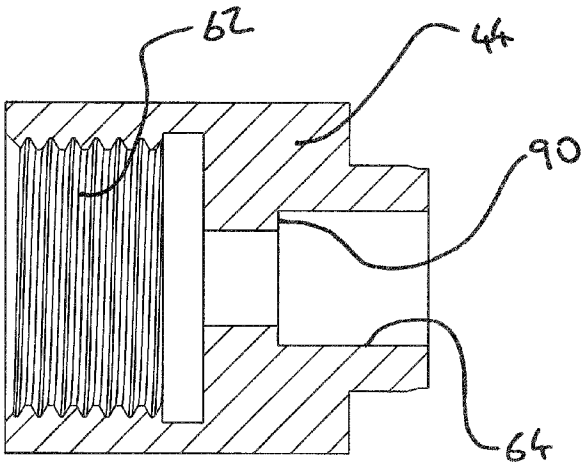
Figure 9C:
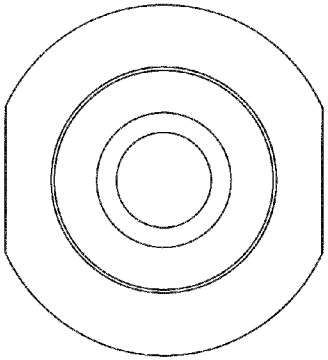

Press sleeve body 44 is affixed to the angled body 46 via the angled body-press sleeve attachment 66. In the examples shown, the attachment 66 is a press-fit between the components, although other attachments are possible, for example a threaded, soldered, welded or glued attachment. Once the press sleeve body 44 and the angled body 46 are attached, the press sleeve dielectric 48 is held captive between the angled body 46 and the press sleeve body 44 by a surface 90 of inner bore 64 of the press sleeve body 44. An example of the press sleeve body 44 is shown in more detail in FIGS. 9A-9C.

Figure 10A:
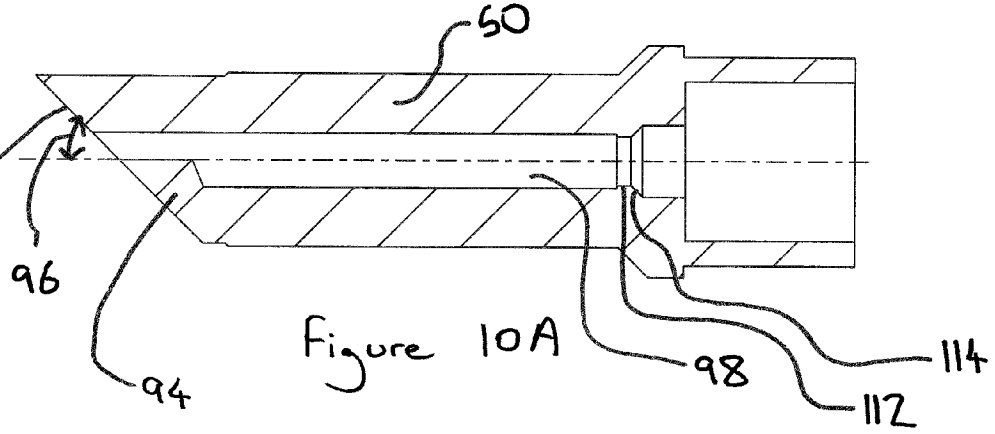
FIGS. 10A, 10B and 10C are left side cross section, left-front-top perspective and left-rear-bottom perspective views, respectively, of a plug dielectric according to an exemplary embodiment of the present application.
Figure 10B:
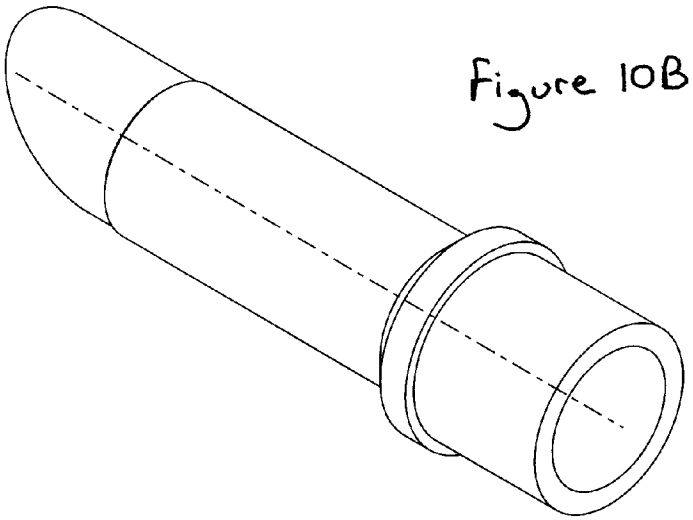
Figure 10C:
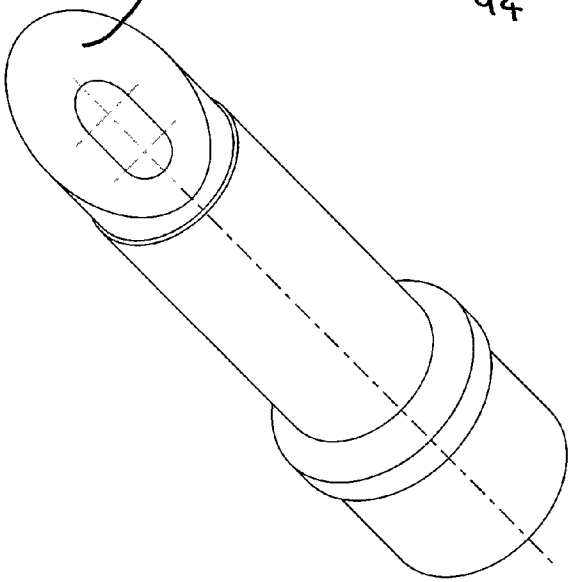

An example of the plug dielectric 50 is shown in more detail in FIGS. 10A-10C. Plug dielectric may include a beveled end surface 92 and a bend relief 94. The beveled end surface 92 forms an angle 96 with the main axis of the plug dielectric 50. In one example, angle 96 is configured to be substantially half of the angle between axes 18 and 20 or half of angle 80, although other angles are possible. In one example, angles 88 and 96 may be similar or substantially the same. As shown in FIG. 6, bend relief 94 provides a space for the bend 74 of the angled contact 52 to exist without detrimental impingement. Once the plug dielectric 50 is inserted into the angled body 46, the beveled end surface 92 of the plug dielectric 50 and the beveled end surface 84 of the press sleeve dielectric 48 may desirably be flush and aligned. The beveled end surface 92 of the plug dielectric 50 and the beveled end surface 84 of the press sleeve dielectric 48 may be left to simply abut one another or may be glued, welded or otherwise attached to one another.

In one example, the intermediate outer contact 56 is attached to the angled body 46 via a press-fit within the intermediate outer contact receiving groove 68. Such an attachment ensures good electrical contact between the intermediate outer contact 56 and the angled body 46 so that an electric field reentrant path may be prevented. In another example, shown in FIG. 6, an angled body 46 may be provided with a forward projecting member 120 configured to engage an inner bore of an intermediate outer contact 56 at a location separate from the intermediate outer contact receiving groove 68 (and without another electrical connection between the outer contact receiving groove 68 and the contact point of the forward projecting member 120) to ensure a good electrical contact therebetween. In one example, such engagement may be in the form of a press-fit or friction-fit. Such engagement may also be welded, brazed, soldered or otherwise fixedly adhered. The location of the engagement between the forward projecting member 120 and the intermediate outer contact 56 towards the connector end 16 of the angled adapter 10 may provide additional prevention of electric field reentrant paths. In the example shown in FIG. 6, for example, the engagement between the forward projecting member 120 and the intermediate outer contact 56 is located adjacent captivation features 108 and 110 of the plug contact 54.

Figure 11C:
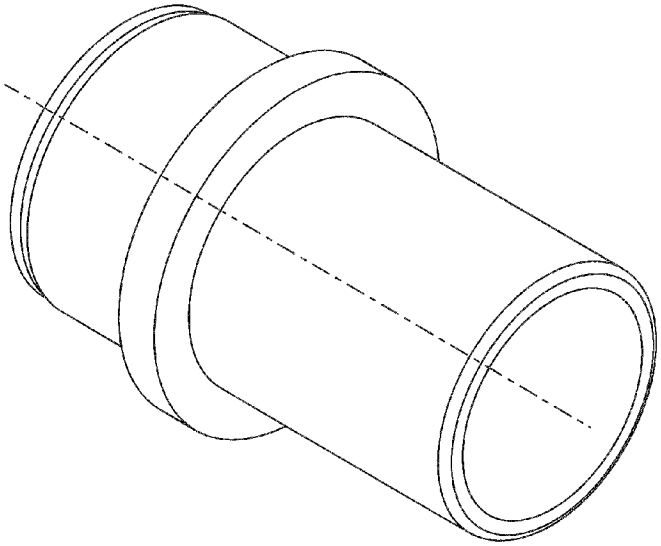
FIGS. 11A, 11B and 11 C are left side cross section, left side and left-front-top perspective views, respectively, of an intermediate outer contact according to an exemplary embodiment of the present application.
Figure 11A:
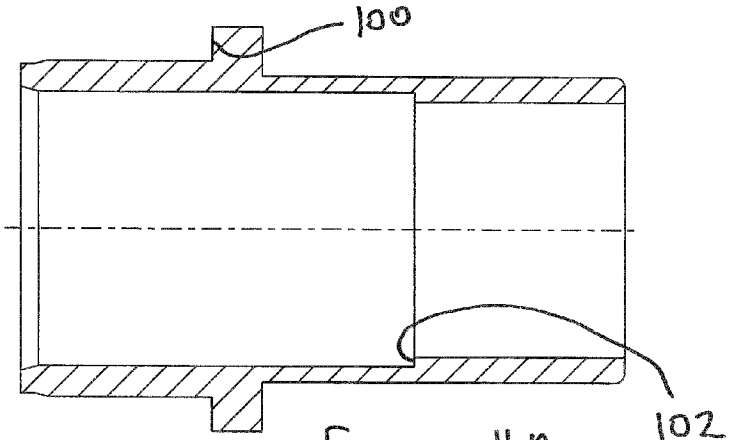
Figure 11B:
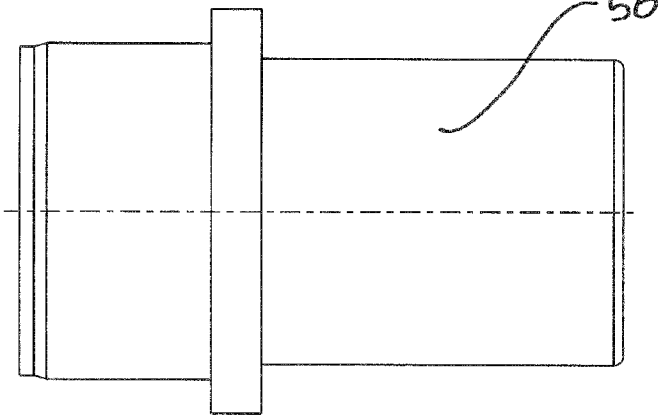
Figure 12B:
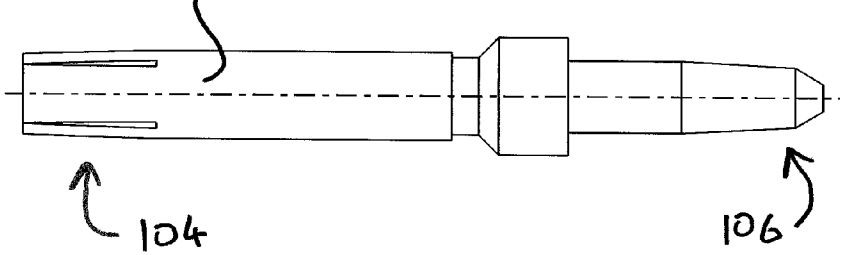
FIGS. 12A, 12B, 12C and 12D are front side, right side, right side partial cross section and left-front-top perspective views, respectively, of a plug contact according to an exemplary embodiment of the present application.
Figure 12C:
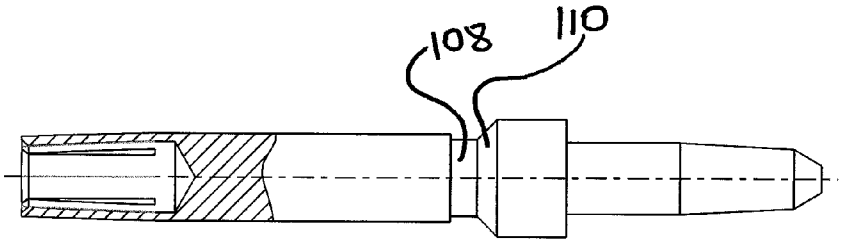
Figure 12A:
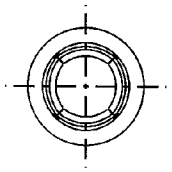
Figure 12D:
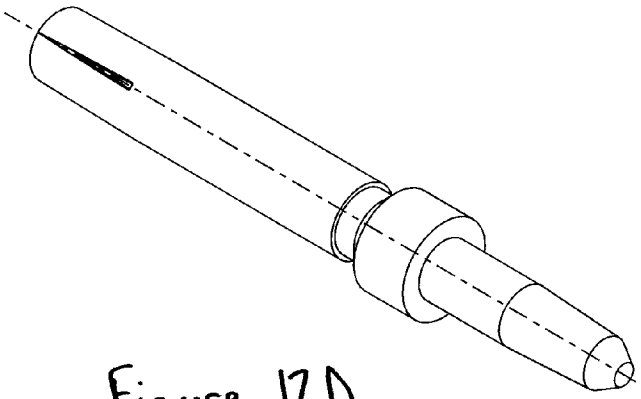
Figure 13C:
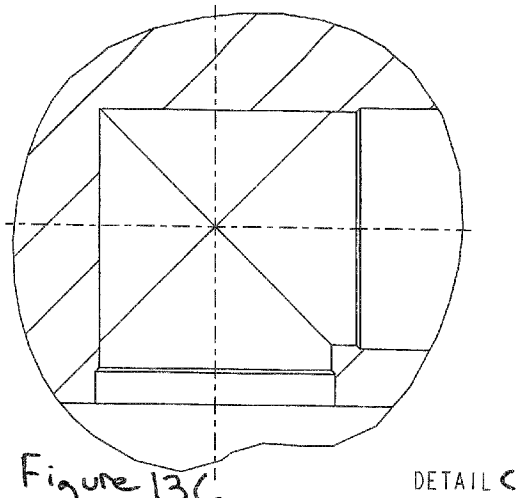
FIG. 13C is a left side cross section detail view corresponding to "Detail C" in the left side cross section view of FIG. 13B of an angled body according to an exemplary embodiment of the present application.
Figure 13D:
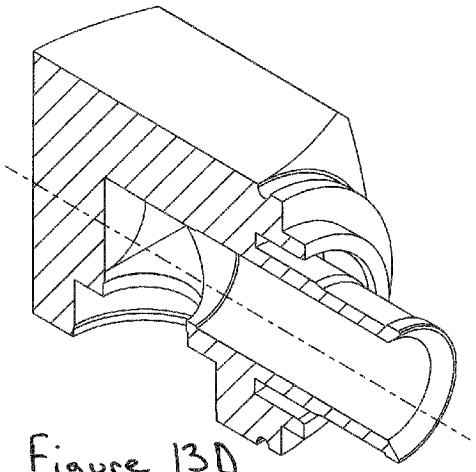
FIGS. 13A, 13B and 13D are top, left side cross section and left-front-top perspective cross section views, respectively, of an angled body according to an exemplary embodiment of the present application.
Figure 13A:
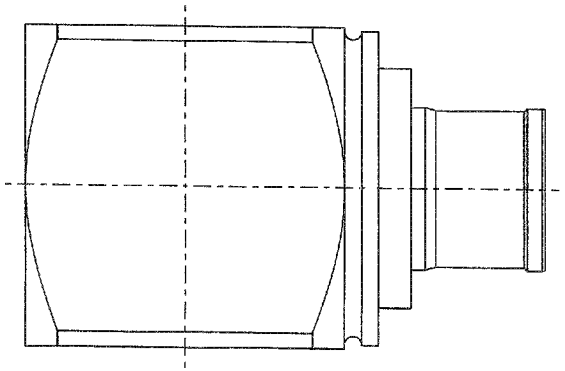
Figure 13B:
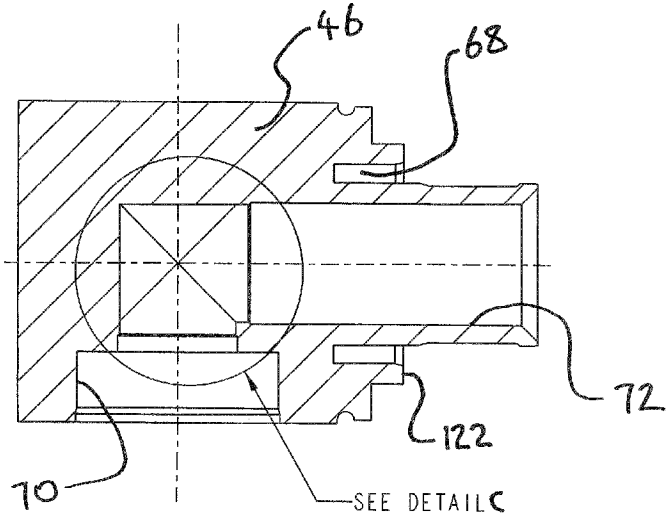

An example of the intermediate outer contact 56 is shown in more detail in FIGS. 11A-11C. In one example of an intermediate outer contact 56 for an angled adapter 10 for use with signals up to, for example, 18 GHz, the intermediate outer contact 56 may not include any slots in an end thereof towards the connection end 16 of the angled adapter 10. In another example of an intermediate outer contact 56 for use with signals up to, for example, 11 GHz, the intermediate outer contact 56 may be provided with one or more slots in an end thereof towards the connector end 16 of the angled adapter 10. Such slots may be configured to provide a complete electrical path even if a less than ideal mating torque is applied between an external connector and the adapter 10 at connection end 16. An example of an angled body 46 is shown in more detail in FIGS. 13A-13D. C-Clip 58 is fitted around intermediate outer contact 56 and is trapped between a forward member of angled body 46 and the intermediate outer contact 56 when the intermediate outer contact 56 is assembled into the intermediate outer contact receiving groove 68. An external shoulder 100 of the intermediate outer contact 56 captures the c-clip 58 against a forward surface 122 of angled body 46 while an internal surface 102 of the intermediate outer contact 56 captures the plug dielectric 50 within the angled body 46 and intermediate outer contact 56.

Plug contact 54 is inserted into the internal bore 98 of plug dielectric 50. An example of the plug contact 54 is shown in more detail in FIGS. 12A-12D. Plug contact 54 may be provided with a female end 104, a male end 106 and a groove including an undercut 108 and a chamfer 110. As shown in FIG. 10A, the plug dielectric may include a captivation feature such as a ridge including a flat 112 with a reduced inner diameter and a chamfer 114. For example, the plug dielectric may be molded or may be machined to produce the flat 112 and chamfer 114. As shown in FIG. 6, once assembled, undercut 108 is adjacent to flat 112 and chamfer 110 is adjacent to chamfer 114. Undercut 108 and chamfer 110 provide signal transmission characteristics to the angled adapter allowing transmission of signals at high frequencies, such as up to 18 GHz. The diameter and shape of the undercut 108 and chamfer 110 may be configured according to the signal transmission characteristics required by a particular application. In the example shown, chamfer 110 is provided towards the male end 106 of the plug contact 54 while the undercut 108 is provided towards the female end 104 of the plug contact 54. In this orientation, the corresponding chamfer 114 helps to guide the plug contact 54 during assembly into the internal bore 98 of the plug dielectric 50 even if the plug dielectric 50 is slightly deformed during a forcible insertion of the plug contact 54. Once inserted, the mate of the undercut 108 and chamfer 110 with the flat 112 and chamfer 114, respectively, mechanically captures the plug contact 54 within the plug dielectric 50. Also, when inserted, the female end 104 of the plug contact 54 mates with the male end 76 of bent contact 52 to provide an uninterrupted electrical connection between the bent contact 52 and the plug contact 54.

Gasket 60 is inserted over intermediate outer contact 56. C-clip 58 may then be compressed radially, for example using tooling designed for that purpose, and coupling nut 116 may be fitted over the compressed C-clip 58. Alternatively, coupling nut 116 may be forcibly fitted over the c-clip 58, radially compressing it in the process. Once the coupling nut 116 is fitted over the c-clip 58, the c-clip 58 is allowed to snap into a groove 118 in the coupling nut 116. Thus, the coupling nut 116 is captured onto the intermediate outer contact 56 by c-clip 58. In turn, c-clip 58 is held captive by the engagement of intermediate outer contact 56 within intermediate outer contact receiving groove 68 and the engagement between the forward projecting member 120 and the inner bore of the intermediate outer contact 56. Thus, when coupling nut 116 is threaded onto an external connector and tightened, the coupling nut 116 exerts a longitudinal force along the connector axis 18 acting to disengage the intermediate outer contact 56 from the adapter body 46. However, the attachments of the intermediate outer contact 56 to the angled body 46 at intermediate outer contact receiving groove 68 and at forward projecting member 120 (which may both be press-fit attachments, as discussed above) are configured to resist such longitudinal force.

Figure 5:
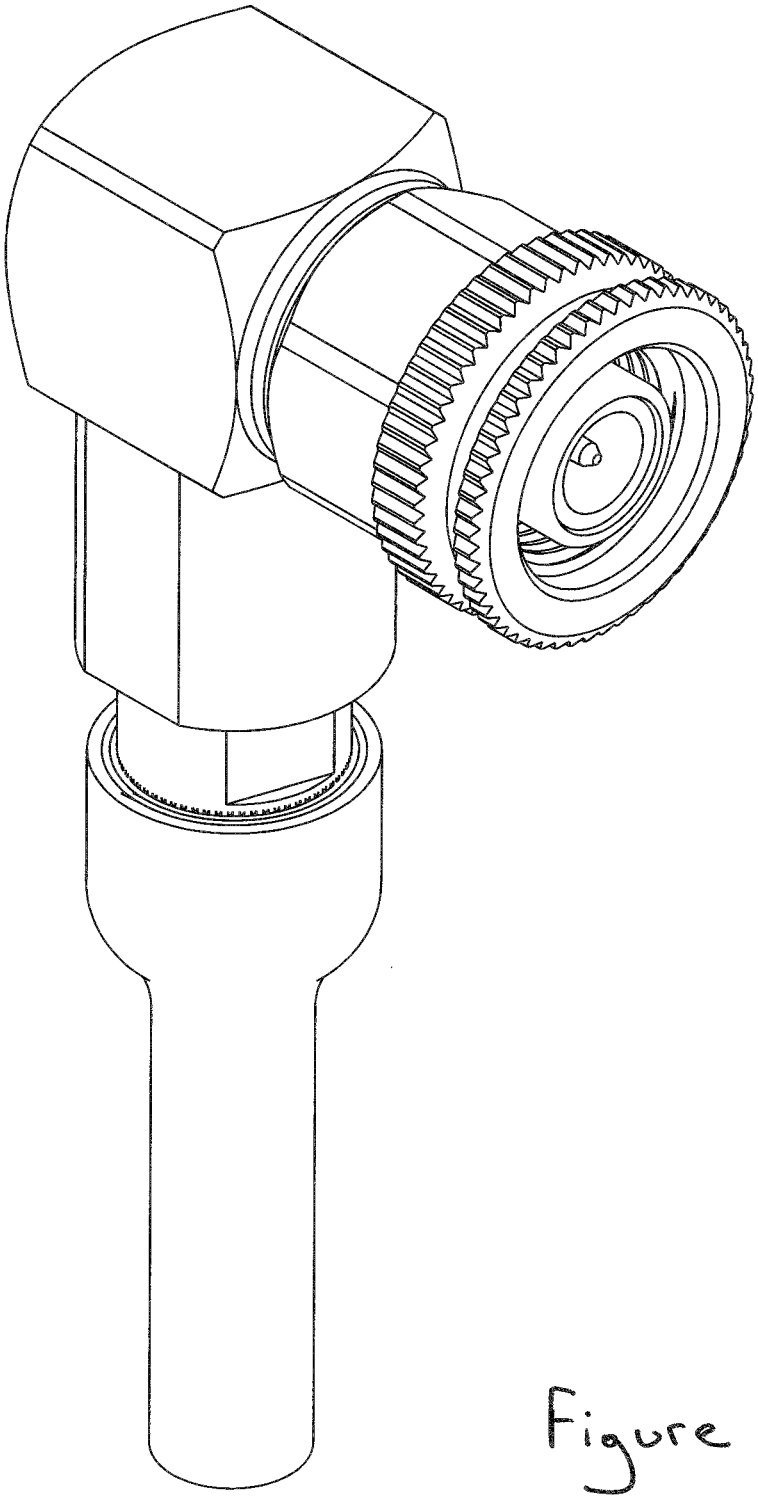
FIG. 5 is a perspective view of a coaxial angled adapter and a cable in an assembled configuration according to an exemplary embodiment of the present application.

The angled adapter 10 may be attached to the cable adapter 12. In one example, shown in FIGS. 3, 4 and 5, the female threads 62 of press sleeve body 44 are threaded onto the male threads 26 of the cable adapter body 22. Of course, other attachment arrangements are also possible.

Materials for the various components may be chosen from among a wide range of suitable materials. In one example, angled body 46, press sleeve body 44, intermediate outer contact 56 and coupling nut 116 may be formed of passivated stainless steel (such as by machining or casting), bent contact 52 and plug contact 54 may be manufactured of beryllium-copper or phosphor-bronze and then gold plated, press sleeve dielectric 48 and plug dielectric 50 may be formed of (such as by machining or molding) PTFE (Polytetrafluoroethylene, a brand of which is Teflon), c-clip 58 may be manufactured from beryllium-copper or phosphor-bronze and gasket 60 may be manufactured from silicon rubber.

In an aspect of the present disclosure, the dielectric components 48 and 50 are each captured in the angled adapter by a mechanical feature. For example, the press sleeve dielectric 48 may be mechanically captured within the press sleeve body 44 and the angled body 46 by surface 90 of the press sleeve body 44. In another example, plug dielectric 50 may be mechanically captured within angled body 46 and intermediate outer contact 56 by surface 102 of the intermediate outer contact 56. In environments with large temperature or pressure swings, such mechanical capturing ensures that the dielectrics (which may be formed of a plastic such as PTFE) stay in place no matter the environment into which the adapter is placed, a particular concern of adapters configured for high frequency signal transmission.

In another aspect of the present disclosure, the intermediate outer contact 56 prevents the existence of a reentrant path within the angled adapter 10. For further discussion of reentrant path creation and the resultant signal transmission problems associated therewith, see U.S. Pat. No. 7,381,089 which is incorporated by reference herein in its entirety. In other words, the presence of intermediate outer contact 56 adjacent the plug dielectric at the connector end 16 of the adapter prevents any substantial gap through which errant electrical field radiation may propagate which could cause resonances or other disturbances at high signal frequencies.

In yet another aspect of the present disclosure, the provision of an intermediate outer contact 56 as a separate component from the angled body 46 allows for several advantages over a unitary angled body including an outer contact at the connector end 16. For example, surface 102 of the intermediate outer contact 56 (which would be difficult, costly, time intensive and subject to a higher manufacturing failure rate if provided in a unitary angled body 46) allows for a mechanical capture of the plug dielectric 50 within the angled body 46 and the intermediate outer contact 56. Moreover, by assembling the intermediate outer contact into the angled body 46 after the plug dielectric 50 is inserted into the angled body 46, detrimental deformation of the plug dielectric 50, which could lead to problematic gaps and reentrant paths, as discussed above, may be avoided. Such detrimental deformation of the plug dielectric 50 may be caused, for example, if a plug dielectric 50 is forcibly inserted into a unitary angled body 46 past an internal surface 102.

In still another aspect of the present disclosure, the connector end 16 of the angled adapter 10 (including the plug contact 54, the plug dielectric 50, the intermediate outer contact 56 and the coupling nut 116) may be configured to adhere to a recognized or universal specification for high frequency connectors. One such specification maintained by the United States military is MIL-PRF-39012 and more specifically MIL-STD-348, both of which are incorporated by reference herein in their entirety.

In addition, the embodiments and examples above are illustrative, and many variations can be introduced on them without departing from the spirit of the disclosure or from the scope of the appended claims. For example, elements and/or features of different illustrative and exemplary embodiments herein may be combined with each other and/or substituted for each other within the scope of this disclosure. As another example, two or more of the various components described herein may be combined into one or more consolidated components or one of the various single components described herein may be provided as two or more sub-components.

What is claimed is:

1. An adapter comprising:

an adapter body including:

an internal bore aligned along a connector axis, and a forward projecting member that is aligned along the connector axis and provides at least a portion of a surface of the internal bore;

an outer contact fixed to the adapter body such that a first electrical connection is made between the outer contact and the adapter body by the fixation, the outer contact having an internal bore aligned with the connector axis;

a dielectric disposed at least partially within at least one of the internal bore of the adapter body and the internal bore of the outer contact, the dielectric having an internal bore aligned with the connector axis;

an inner contact disposed at least partially within the internal bore of the dielectric, wherein the forward projecting member of the adapter body makes a second electrical connection with the outer contact separate from the first electrical connection, there being no physical connection between the adapter body and the outer contact in a region between the first electrical connection and the second electrical connection.

2. The adapter of claim 1, wherein the outer contact is fixed to the adapter body at an end of the outer contact.

3. The adapter of claim 1, wherein the first electrical connection is spaced apart from the second electrical connection along the connector axis.

4. The adapter of claim 1, wherein the adapter body includes a groove to receive the outer contact.

5. The adapter of claim 1, wherein the forward projecting member of the adapter body is the furthest projecting portion of the adapter body along the connector axis.

6. The adapter of claim 1, wherein the outer contact mechanically captures the dielectric within the adapter body.

7. The adapter of claim 1, wherein the inner contact includes a groove in an outer surface thereof and the second electrical connection between the adapter body and the outer contact is adjacent to the groove of the inner contact.

8. The adapter of claim 7, wherein the dielectric mechanically captures the groove of the inner contact.

9. The adapter of claim 1, wherein the dielectric is disposed at least partially within both the internal bore of the adapter body and the internal bore of the outer contact.

* * * * *